US008922535B2

(12) United States Patent
Yang et al.

(10) Patent No.: US 8,922,535 B2
(45) Date of Patent: Dec. 30, 2014

(54) TIMING CONTROLLER, SOURCE DRIVER, DISPLAY DRIVING CIRCUIT, AND DISPLAY DRIVING METHOD

(71) Applicant: Novatek Microelectronics Corp., Hsinchu (TW)

(72) Inventors: Shun-Hsun Yang, Hsinchu (TW); Chia-Wei Su, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 13/845,080

(22) Filed: Mar. 17, 2013

(65) Prior Publication Data

US 2014/0132575 A1 May 15, 2014

(30) Foreign Application Priority Data

Nov. 9, 2012 (TW) ..... 101141753 A

(51) Int. Cl.
*G09G 5/00* (2006.01)

(52) U.S. Cl.
CPC ..... *G09G 5/00* (2013.01)
USPC ..... 345/204

(58) Field of Classification Search
CPC . G09G 3/3685; G09G 3/3688; G09G 3/3692; G09G 2300/04; G09G 2300/0404; G09G 2300/0408; G09G 2310/0264; G09G 2320/00; G09G 2320/02; G09G 2330/06; G09G 5/00
USPC ..... 345/98, 204, 205, 206, 690
See application file for complete search history.

(56) References Cited

U.S. PATENT DOCUMENTS

| | | | | |
|---|---|---|---|---|
| 6,075,513 | A * | 6/2000 | Reddy et al. | 345/589 |
| 6,563,483 | B1 * | 5/2003 | Sakumoto | 345/98 |
| 2011/0199368 | A1 * | 8/2011 | Huang et al. | 345/213 |
| 2011/0199369 | A1 * | 8/2011 | Huang et al. | 345/213 |
| 2012/0146965 | A1 * | 6/2012 | Baek et al. | 345/204 |
| 2012/0242628 | A1 * | 9/2012 | Yuan et al. | 345/204 |

FOREIGN PATENT DOCUMENTS

TW 201137821 A1 11/2011

OTHER PUBLICATIONS

Taiwanese Office Action dated on Jul. 10, 2014.

* cited by examiner

*Primary Examiner* — Tom Sheng
(74) *Attorney, Agent, or Firm* — Rabin & Berdo, P.C.

(57) ABSTRACT

A timing controller is provided. The timing controller includes a timing control circuit, a first scrambler and a second scrambler. The timing control circuit provides first source driving data and second source driving data. The first scrambler scrambles the first source driving data according to a first random number to generate first scrambled data. The second scrambler scrambles the second driving source data according to a second random number to generate second scrambled data. The second random number is different from the first random number.

25 Claims, 6 Drawing Sheets

TIMING CONTROLLER, SOURCE DRIVER, DISPLAY DRIVING CIRCUIT, AND DISPLAY DRIVING METHOD

This application claims the benefit of Taiwan application Serial No. 101141753, filed Nov. 9, 2012, the subject matter of which is incorporated herein by reference.

BACKGROUND OF THE INVENTION

1. Field of the Invention

The invention relates to a timing controller, a source driver, a display driving circuit and a display driving method.

2. Description of the Related Art

A chipset of a liquid-crystal display (LCD) device includes a timing controller and a source driver. The timing controller generates source driving data according to a video signal input, and outputs the source driving data to the source driver. The source driver drives a display panel of the LCD device according to the source driving data. However, as a data link between the timing controller and the source driver is prone to radiation that causes electromagnetic interference (EMI), applications including Wireless Wide Area Network (WWAL), Bluetooth and military bandwidths may be undesirably affected.

SUMMARY OF THE INVENTION

The invention is directed to a timing controller, a source driver, a display driving circuit and a display driving method.

According to an aspect of the disclosure, a display driving circuit is provided. The display driving circuit includes a timing controller and a source driving unit. The timing controller includes a timing control circuit, a first scrambler and a second scrambler. The timing controller provides first source driving data and second source driving data. The first scrambler scrambles the first source driving data according to a first random number to generate first scrambled data. The second scrambler scrambles the second source driver data according to a second random number to generate second scrambled data. The second random number is different from the first random number. The source driving unit includes a first descrambler, a second descrambler and a source driving circuit. The first descrambler descrambles the first scrambled data according to the first random number to generate the first source driving data. The second descrambler descrambles the second scrambled data according to the second random number to generate the second source data. The source driving circuit drives a display panel according to the first source driving data and the second source driving data.

According to another aspect of the disclosure, a timing controller is provided. The timing controller includes a timing control circuit, a first scrambler and a second scrambler. The timing control circuit provides first source driving data and second source driving data. The first scrambler scrambles the first source driving data according to a first random number to generate first scrambled data. The second scrambler scrambles the second source driver data according to a second random number to generate second scrambled data. The second random number is different from the first random number.

According to another aspect of the disclosure, a source driver is provided. The source driver includes a descrambler, a multiplexer and a source driving circuit. The multiplexer outputs a random number to the descrambler according to a selection signal. The descrambler descrambles scrambled data according to the random number to generate source driving data. The source driving circuit drives a display panel according to the source driving data.

According to yet another aspect of the disclosure, a display driving method is provided. The display driving method includes: providing first source driving data and second source driving data; generating a first random number and a second random number, the second random number being different from the first random number; scrambling the first source driving data according to the first random number to generate first scrambled data, and scrambling the second source driving data according to the second random number to generate second scrambled data; outputting the first scrambled data and the second scrambled data to a source driving unit; descrambling the first scrambled data according to the first random number to generate the first source driving data, and descrambling the second scrambled data according to the second random number to generate the second source driving data; and driving a display panel according to the first source driving data and the second source driving data.

The above and other aspects of the invention will become better understood with regard to the following detailed description of the preferred but non-limiting embodiments. The following description is made with reference to the accompanying drawings.

DETAILED DESCRIPTION OF THE INVENTION

First Embodiment

Figure 1:
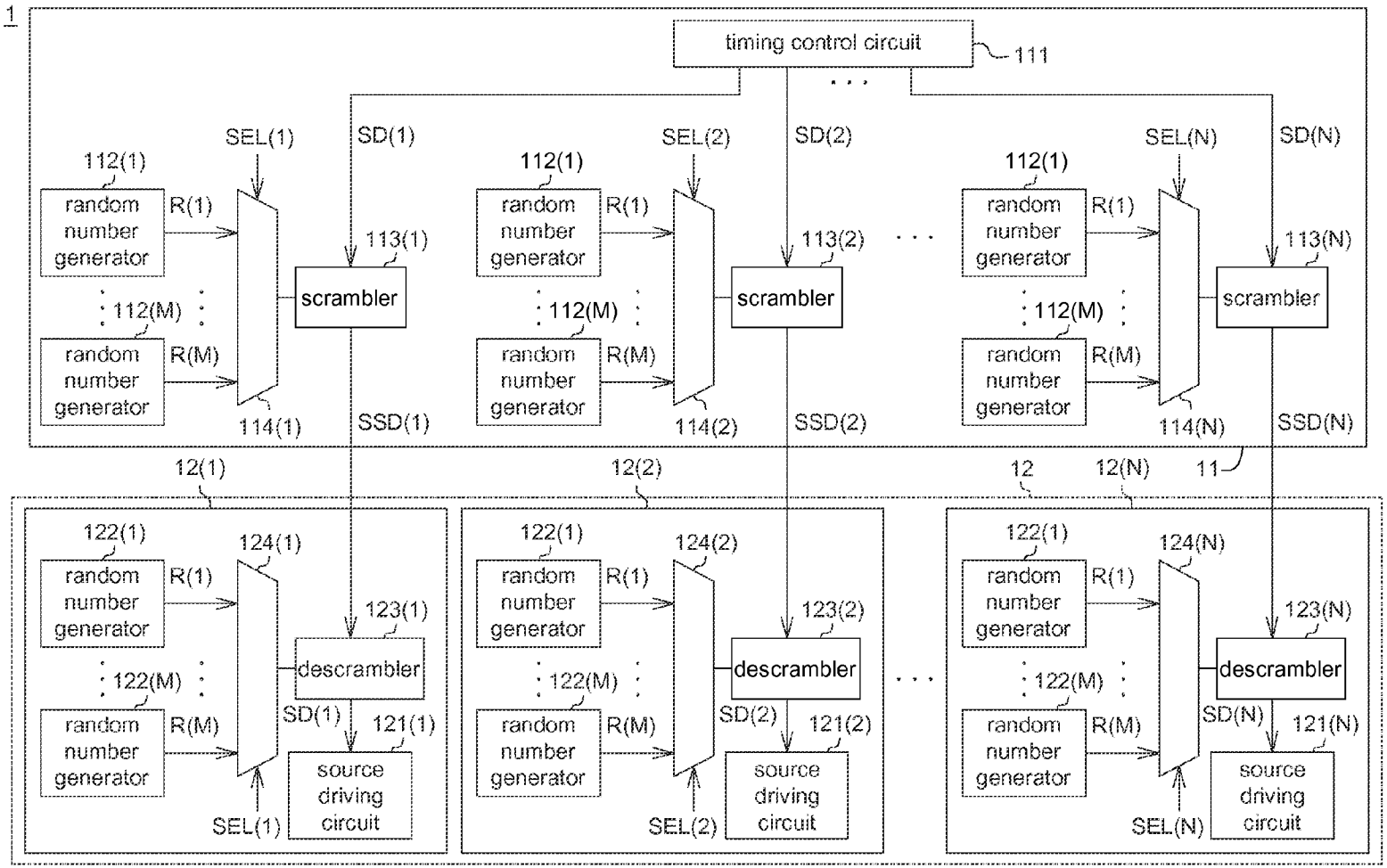
FIG. 1 is a display driving circuit according to a first embodiment.

FIG. 1 shows a display driving circuit according to a first embodiment. Referring to FIG. 1, a display driving circuit 1 includes a timing controller 11 and a source driving unit 12. The timing controller 11 includes a timing control circuit 111, an N number of sets of random number generators, scramblers 113(1) to 113(N), and multiplexers 114(1) to 114(N). Each set of random number generators includes random number generators 112(1) to 112(M). The timing control circuit 111 provides source driving data SD(1) to SD(N). The random number generators 112(1) to 112(M) generate random numbers R(1) to R(N), and output the random numbers R(1) to R(N) to the multiplexers 114(1) to 114(N), respectively. The random numbers R(1) to R(M) are different from one another. For illustration purposes, M equal to N is taken as an example in the first embodiment. In an alternative embodiment, M may be greater than or smaller than N, and some of the random numbers R(1) to R(N) may be the same. The multiplexers 114(1) to 114(N) output the random numbers R(1) to R(N) to the scramblers 113(1) to 113(N) according to selection signals SEL(1) to SEL(N), respectively. The scramblers 113(1) to 113(N) generate scrambled data SSD(1) to SSD(N) according to the random numbers R(1) to R(N), respectively.

More specifically, the multiplexer 114(1) outputs the random number R(1) to the scrambler 113(1) according to the selection signal SEL(1), the multiplexer 114(2) outputs the random number R(2) to the scrambler 113(2) according to the selection signal SEL(2), and so forth. That is, the multiplexer 114(N) outputs the random number R(N) to the scrambler 113(N) according to the selection signal SEL(N).

The source driving unit 12 includes source drivers 12(1) to 12(N) having an identical design. The source drivers 12(1) to 12(N) include source driving circuits 121(1) to 121(N), a set of random number generators, descramblers 123(1) to 123(M), and multiplexers 124(1) to 124(N), respectively. Each set of random number generators include random number generators 122(1) to 122(M). The random number generators 122(1) to 122(M) generate random numbers R(1) to R(M), respectively, and the random numbers R(1) to R(M) are different from one another. The multiplexers 124(1) to 124(N) output the random numbers R(1) to R(N) to the descramblers 123(1) to 123(N) according to the selection signals SEL(1) to SEL(N), respectively. The descramblers 123(1) to 123(1) to 123(N) descramble the scrambled data SSD(1) to SSD(N) according to the random numbers R(1) to R(N) to generate the source driving data SD(1) to SD(N), respectively. The source driving circuits 121(1) to 121(N) drive a display panel according to the source driving data SD(1) to SD(N), respectively.

More specifically, the multiplexer 124(1) outputs the random number R(1) to the descrambler 123(1) according to the selection signal SEL(1) the multiplexer 124(2) outputs the random number R(2) to the descrambler 123(2) according to the selection signal SEL(2), and so forth. That is, the multiplexer 124(N) outputs the random number R(N) to the descrambler 123(N) according to the selection signal SEL (N).

Since the scramblers 113(1) to 113(N) generate the scrambled data SSD(1) to SSD(N) according to different random numbers R(1) to R(N), respectively, a maximum random level for data transmission between the timing controller 11 and the source driving unit 12 can be achieved to further lower risks of electromagnetic interference.

Second Embodiment

Figure 2:
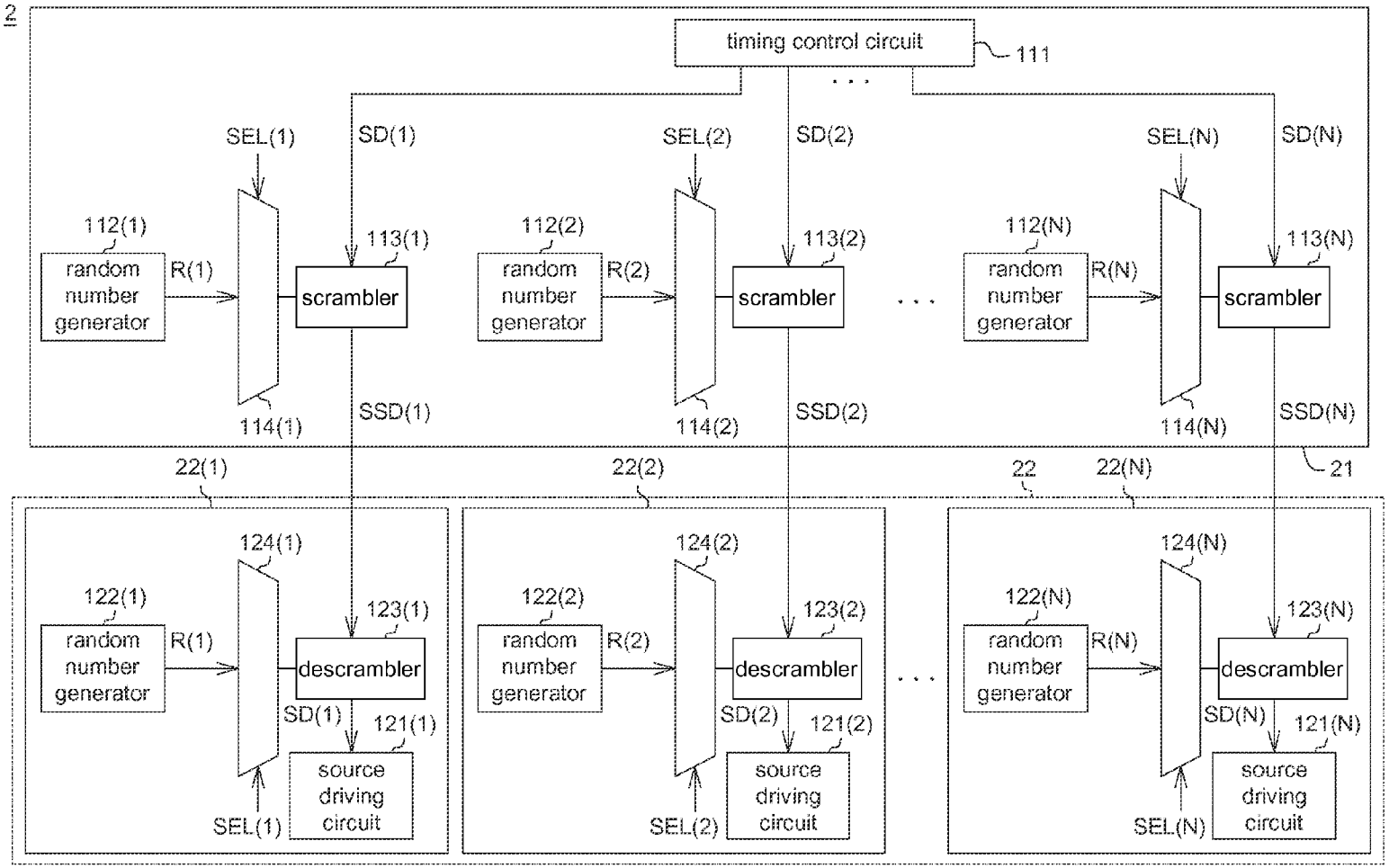
FIG. 2 is a display driving circuit according to a second embodiment.

FIG. 2 shows a display driving circuit according to a second embodiment. A display driving circuit 2 includes a timing controller 21 and a source driving unit 22. The source driving unit 22 includes source drivers 22(1) to 22(N). Referring to FIGS. 1 and 2, a main difference of the display driving circuit 2 from the display driving circuit 1 is that, the timing controller 21 requires only an N number of random number generators. When the selection signals SEL(1) to SEL(N) are respectively equal to 1 to N, the multiplexers 114(1) to 114 (N) output random numbers R(1) to R(N), respectively. In contrast, the source driving unit 22 includes the source drivers 22(1) to 22(N), each of which requiring only one random number generator. When the selection signals SEL(1) to SEL (N) are respectively equal to 1 to N, the multiplexers 124(1) to 124(N) output the random numbers R(1) to R(N), respectively. With the reduced number of the random number generators, production costs can be further decreased for enhanced product competitiveness.

Third Embodiment

Figure 3:
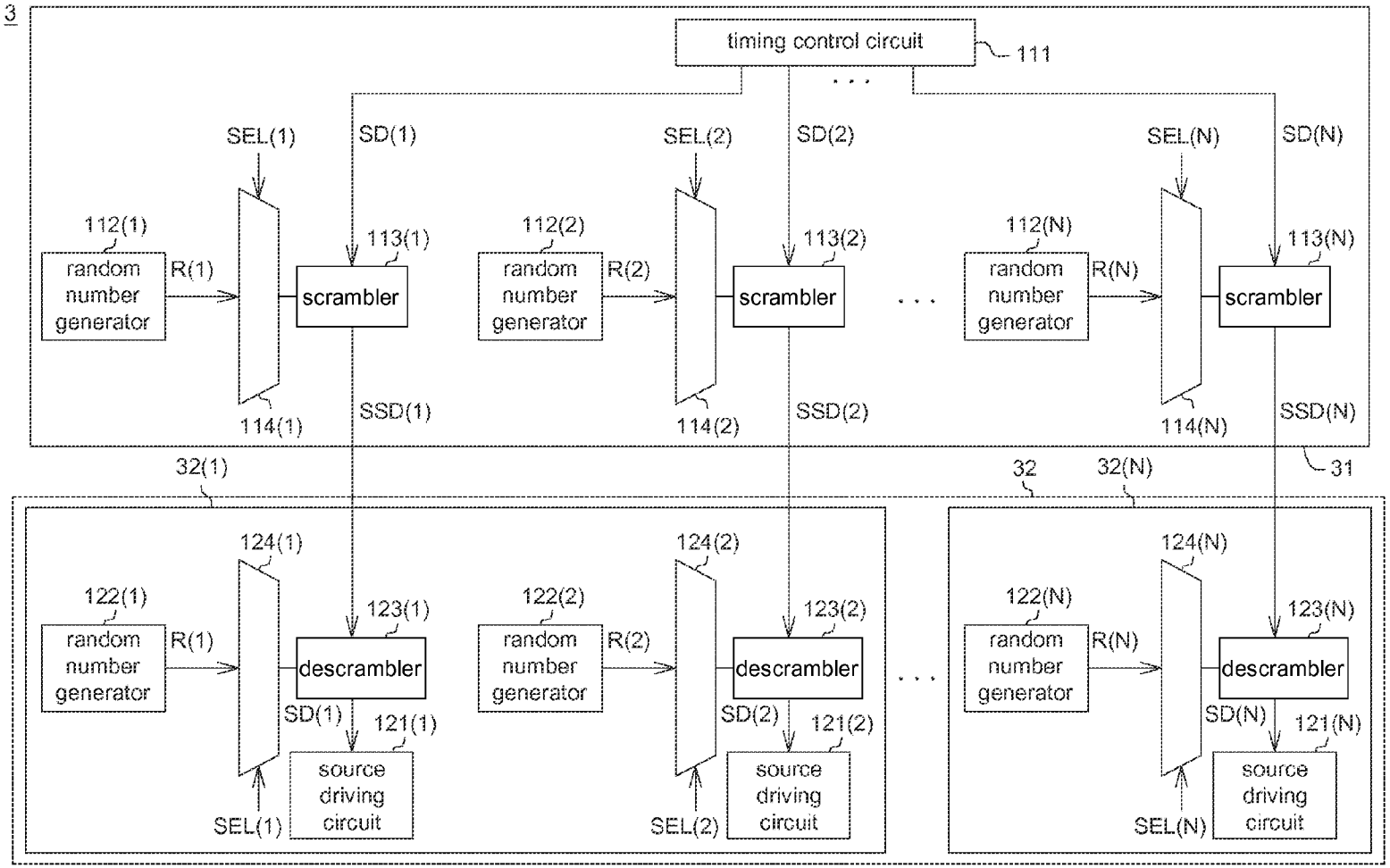
FIG. 3 is a display driving circuit according to a third embodiment.

FIG. 3 shows a display driving circuit according to a third embodiment. A display driving circuit 3 includes a timing controller 31 and a source driving unit 32. The source driving unit 32 includes source drivers 32(1) to 32(N). Referring to FIGS. 2 and 3, a main difference of the display driving circuit 3 from the display driving circuit 2 is that the source driver 32(1) differs from the source driver 22(1). The source driver 32(1) includes a source driving circuit 121(1), random number generators 122(1) and 122(2), descramblers 123(1) and 123(2), and multiplexers 124(1) and 124(2). In an alternative embodiment, the numbers of the random number generators, descramblers and multiplexers in one single driver may be flexibly adjusted according to actual application requirements.

Fourth Embodiment

Figure 4:
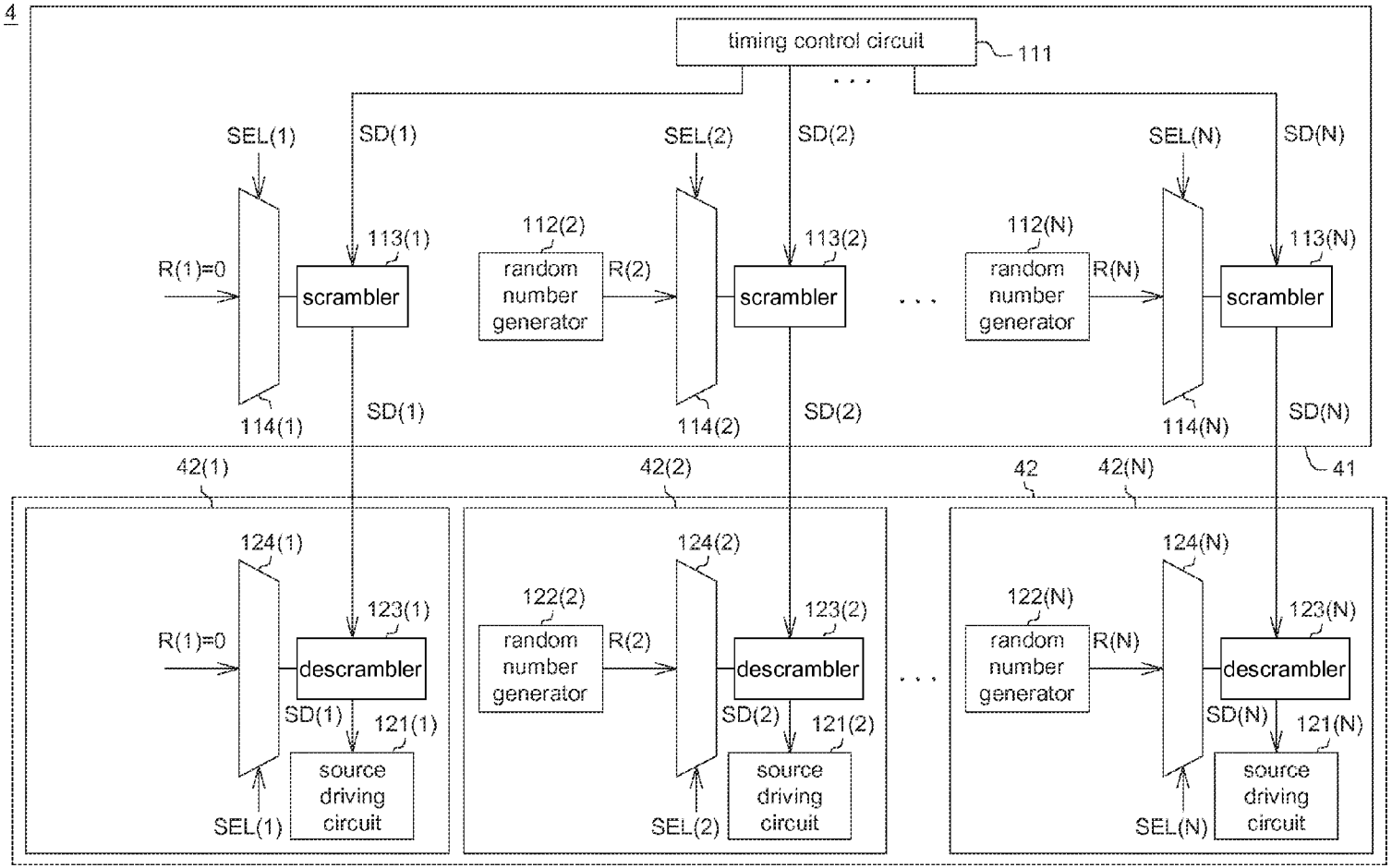
FIG. 4 is a display driving circuit according to a fourth embodiment.

FIG. 4 shows a display driving circuit according to a fourth embodiment. A display driving circuit 4 includes a timing controller 41 and a source driving unit 42. The source driving unit 42 includes source drivers 42(1) to 42(N). Referring to FIGS. 2 and 4, a main difference of the display driving circuit 4 from the display driving circuit 2 is that, the random number generator 112(1) in the timing controller 21 is replaced by a random number R1 equal to 0 in the timing controller 41. Correspondingly, the source driver 42 replaces the random number generator 122(1) in the source driver 22 by the random number R1 equal to 0.

Fifth Embodiment

Figure 5:
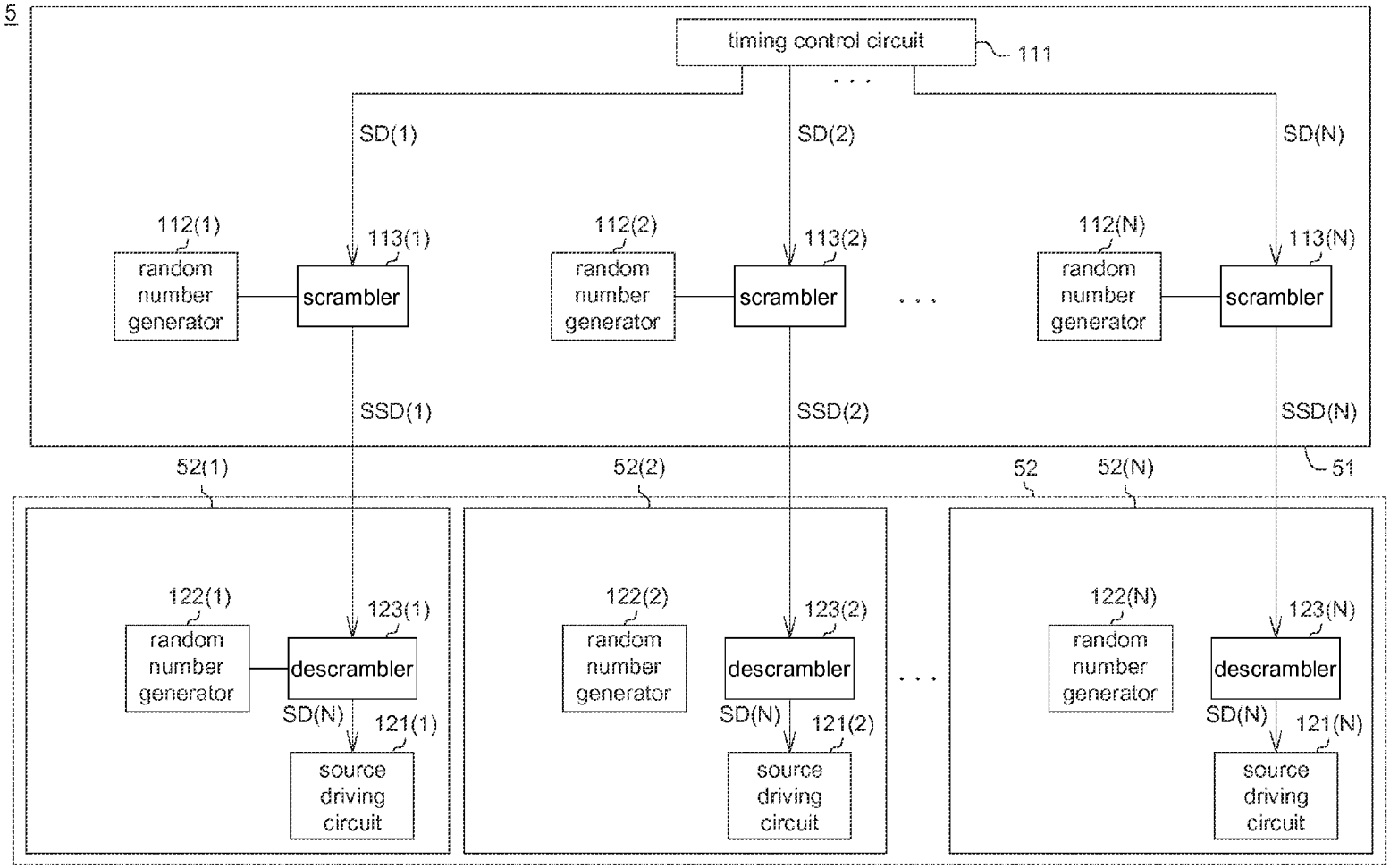
FIG. 5 is a display driving circuit according to a fifth embodiment.

FIG. 5 shows a display driving circuit according to a fifth embodiment. A display driving circuit 5 includes a timing controller 51 and a source driving unit 52. The source driving unit 52 includes source drivers 52(1) to 52(N). Referring to FIGS. 2 and 5, a main difference of the display driving circuit 4 from the display driving circuit 2 is that, the random number generators 112(1) to 112(M) are respectively connected to the scramblers 113(1) to 113(N) without going through the multiplexers 114(1) to 114(N). Correspondingly, the random number generators 122(1) to 122(M) are respectively connected to the descramblers 123(1) to 123(N) without going through the multiplexers 124(1) to 124(N).

Figure 6:
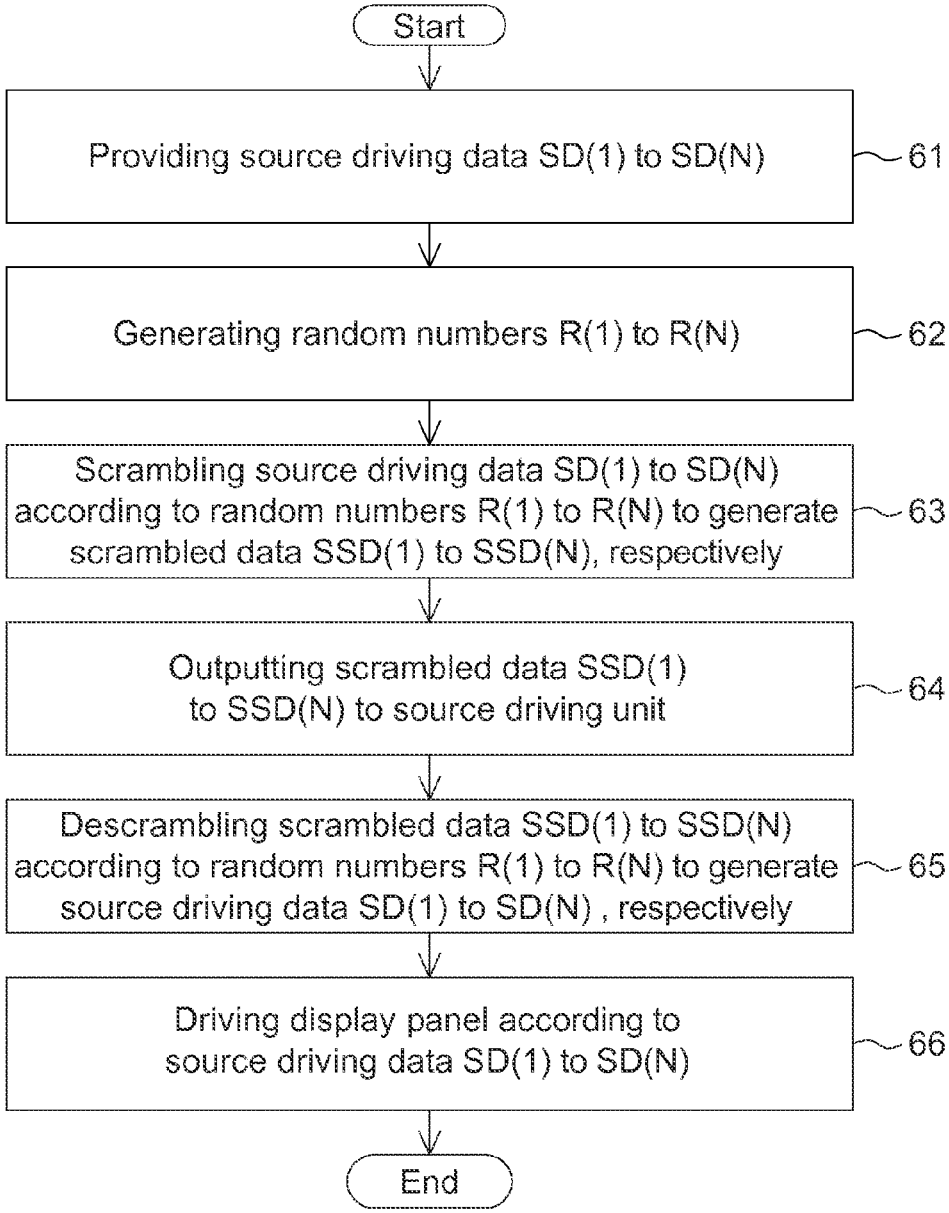
FIG. 6 is a flowchart of a display driving method according to one embodiment.

A display driving method according to one embodiment shall be described below. FIG. 6 shows a flowchart of a display driving method according to one embodiment. Referring to FIGS. 1 and 6, the display driving method, applicable to the foregoing display driving circuit, includes the following steps. In step 61, the timing controller 111 provides the source driving data SD(1) to SD(N). In step 62, the random number generators 112(1) to 112(M) generate the random numbers R(1) to R(M), respectively. The random numbers R(1) to R(M) may be different from one another, or some of the random numbers R(1) to R(M) may be the same. In step 63, the scramblers 113(1) to 113(N) scramble the source driving data SD(1) to SD(N) according to the random numbers R(1) to R(N) to generate the scrambled data SSD(1) to SSD(N), respectively. In step 64, the scramblers 113(1) to 113(N) output the scrambled data SSD(1) to SSD(N) to the source driving unit 12. In step 65, the descramblers 123(1) to 123(N) descramble the scrambled data SSD(1) to SSD(N) according to the random numbers R(1) to R(N) to generate the source driving data SD(1) to SD(N), respectively. In step 66, the source driving circuits 121(1) to 121(N) drive the display panel according to the source driving data SD(1) to SD(N), respectively.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display driving circuit, comprising:

a timing controller, comprising:

a timing control circuit, for providing first source driving data and second source driving data;

a first scrambler, for scrambling the first source driving data according to a first random number to generate first scrambled data; and a second scrambler, for scrambling the second source driving data according to a second random number to generate second scrambled data, the first random number being different from the second random number; and a source driving unit, comprising:

a first descrambler, for descrambling the first scrambled data according to the first random number to generate the first source driving data;

a second descrambler, for descrambling the second scrambled data according to the second random number to generate the second source driving data; and a source driving circuit, for driving a display panel according to the first source driving data and the second source driving data.

2. The display driving circuit according to claim 1, wherein the timing controller further comprises:

a first multiplexer, for outputting the first random number to the first scrambler according to a first selection signal; and a second multiplexer, for outputting the second random number to the second scrambler according to a second selection signal.

3. The display driving circuit according to claim 2, wherein the timing controller further comprises:

a first random number generator, for generating the first random number and outputting the first random number to the first multiplexer; and a second random number generator, for generating the second random number and outputting the second random number to the second multiplexer.

4. The display driving circuit according to claim 3, wherein the timing controller further comprises:

a third random number generator, for generating a third random number and outputting the third random number to the first multiplexer, the third random number being different from the first random number; and a fourth random number generator, for generating a fourth random number and outputting the fourth random number to the second multiplexer, the fourth random number being different from the second random number.

5. The display driving circuit according to claim 1, wherein the source driving unit further comprises:

a first multiplexer, for outputting the first random number to the first descrambler according to a first selection signal; and a second multiplexer, for outputting the second random number to the second descrambler according to a second selection signal.

6. The display driving circuit according to claim 5, wherein the source driving unit further comprises:

a first random number generator, for generating the first random number and outputting the first random number to the first multiplexer; and a second random number generator, for generating the second random number and outputting the second random number to the second multiplexer.

7. The display driving circuit according to claim 6, wherein the source driving unit further comprises:

a third random number generator, for generating a third random number and outputting the third random number to the first multiplexer, the third random number being different from the first random number; and a fourth random number generator, for generating a fourth random number and outputting the fourth random number to the second multiplexer, the fourth random number being different from the second random number.

8. The display driving circuit according to claim 1, wherein the timing controller further comprises:

a first random number generator, for generating the first random number.

9. The display driving circuit according to claim 1, wherein the first random number is zero.

10. The display driving circuit according to claim 1, wherein the source driving unit further comprises:

a first random number generator, for generating the first random number; and a second random number generator, for generating the second random number.

11. The display driving circuit according to claim 1, wherein the first random number generator is connected to the first scrambler, and the second random number generator is connected to the second scrambler.

12. A timing controller, comprising:

a timing control circuit, for providing first source driving data and second source driving data;

a first scrambler, for scrambling the first source driving data according to a first random number to generate first scrambled data; and a second scrambler, for scrambling the second source driving data according to a second random number to generate second scrambled data; the second random number being different from the first random number.

13. The timing controller according to claim 12, further comprising:

a first multiplexer, for outputting the first random number to the first scrambler according to a first selection signal; and a second multiplexer, for outputting the second random number to the second scrambler according to a second selection signal.

14. The timing controller according to claim 12, further comprising:

a first random number generator, for generating the first random number and outputting the first random number to the first multiplexer; and a second random number generator, for generating the second random number and outputting the second random number to the second multiplexer.

15. The timing controller according to claim 14, further comprising:

a third random number generator, for generating a third random number and outputting the third random number to the first multiplexer, the third random number being different from the first random number; and a fourth random number generator, for generating a fourth random number and outputting the fourth random number to the second multiplexer, the fourth random number being different from the second random number.

16. The timing controller according to claim 12, further comprising:

a first random number generator, for generating the first random number; and a second random number generator, for generating the second random number.

17. The timing controller according to claim 12, wherein the first random number is zero.

18. The timing controller according to claim 12, wherein the first random number generator is connected to the first scrambler, and the second random number generator is connected to the second scrambler.

19. A source driver unit, comprising a plurality of source drivers each comprising:

a descrambler, for descrambling scrambled data according to a random number to generate source driving data;

a multiplexer, for outputting the random number to the descrambler according to a selection signal; and a source driving circuit, for driving a display panel according to the source driving data.

20. The source driver according to claim 19, wherein each source driver further comprising:

a random number generator, for generating the random number and outputting the random number to the multiplexer.

21. The source driver according to claim 20, wherein each source driver further comprising:

another random number generator, for generating another random number and outputting to the multiplexer, the multiplexer selectively outputting either one of the random number and the another random number to the descrambler according to the selection signal.

22. The source driver according to claim 19, wherein the random number is zero.

23. A display driving method, comprising:

providing first source driving data and second source driving data;

generating a first random number and a second random number, the second random number being different from the first random number;

scrambling the first source driving data according to the first random number to generate first scrambled data, and scrambling the second source driving data according to the second random number to generate second scrambled data;

outputting the first scrambled data and the second scrambled data to a source driving unit;

descrambling the first scrambled data according to the first random number to generate the first source driving data, and descrambling the second scrambled data according to the second random number to generate the second source driving data; and driving a display panel according to the first source driving data and the second source driving data.

24. The display driving method according to claim 23, further comprising:

outputting the first random number to the first descrambler according to a first selection signal, and outputting the second random number to the second descrambler according to a second selection signal.

25. The display driving method according to claim 23, wherein the first random number is zero.

* * * * *